US007128662B2

(12) United States Patent
Kumamoto

(10) Patent No.: US 7,128,662 B2
(45) Date of Patent: Oct. 31, 2006

(54) GOLF CLUB HEAD

(75) Inventor: Tomio Kumamoto, Kobe (JP)

(73) Assignee: SRI Sports Limted, Kobe (JP)

( * ) Notice: Subject to any disclaimer, the term of this patent is extended or adjusted under 35 U.S.C. 154(b) by 224 days.

(21) Appl. No.: 10/927,004

(22) Filed: Aug. 27, 2004

(65) Prior Publication Data

US 2005/0090330 A1 Apr. 28, 2005

(30) Foreign Application Priority Data

Oct. 23, 2003 (JP) ..... 2003-363648

(51) Int. Cl.
*A63B 53/04* (2006.01)

(52) U.S. Cl. ..... 473/345; 473/347; 473/349

(58) Field of Classification Search ..... 473/345, 473/346, 349, 324, 329, 332, 347
See application file for complete search history.

(56) References Cited

U.S. PATENT DOCUMENTS 5,669,827 A * 9/1997 Nagamoto ..... 473/345
6,623,378 B1 * 9/2003 Beach et al. ..... 473/345
7,037,214 B1 * 5/2006 Nakahara et al. ..... 473/345
2001/0049310 A1 * 12/2001 Cheng et al. ..... 473/334
2001/0055995 A1 12/2001 Cackett et al.
2003/0125127 A1 * 7/2003 Nakahara et al. ..... 473/329
2005/0233831 A1 * 10/2005 Ezaki et al. ..... 473/342
2005/0245328 A1 * 11/2005 Kouno et al. ..... 473/345

FOREIGN PATENT DOCUMENTS

JP 5-51374 U 7/1993

* cited by examiner

*Primary Examiner*—Sebastiano Passaniti
(74) *Attorney, Agent, or Firm*—Birch, Stewart, Kolasch & Birch, LLP

(57) ABSTRACT

The present invention relates to a golf club head composed of a metal member made of at least one kind of metal material and a FRP member made of a fiber reinforced resin, the metal member having a first lap joint part, and the FRP member having a second lap joint part lap-jointed with the first lap joint part and a non-lap joint part, wherein the resin content of the second lap joint part is larger than the resin content of the non-lap joint part.

10 Claims, 12 Drawing Sheets

GOLF CLUB HEAD

This Non-provisional application claims priority under 35 U.S.C. § 119(a) on Patent Application No(s). 2003-363648 filed in Japan on Oct. 23, 2003, the entire contents of which are hereby incorporated by reference.

BACKGROUND OF THE INVENTION

1. Field of the Invention

The present invention relates to a golf club head composed of a metal member made of at least one kind of metal material and a FRP member made of a fiber reinforced resin.

2. Description of the Background Art

In recent years, golf club heads made of a metal material and fiber reinforced resin have been proposed.

The laid-open Japanese utility model application JP-U5-51374 discloses a club head made of a metal material or a fiber reinforced resin, wherein the crown portion is cut out to form a window which can be either left opened or closed by a cover made of a lower specific gravity material.

The laid-open Japanese patent application JP-P2003-62130A discloses a club head formed by integrating a face component made of a metal material and having a turnback along the edge thereof, and an aft-body made of a plurality of plies of prepreg. As shown in FIG. 16, the turnback (a1) of the face component (a) and the front edge portion (b1) of the aft-body (b) are spliced.

In a golf club head having such a spliced structure, the spliced portion is subjected to a large sharing force as the face portion receives a large impact force, and the bonded surface is very liable to come unstuck. This is especially true in case of a large-sized hollow golf club head such as wood-type golf club heads because the wall thickness is thin and thus deformation at impact is relatively large.

SUMMARY OF THE INVENTION

It is therefore, an object of the present invention to provide a golf club head, in which the joint portion is increased in the strength, and thereby the durability of the club head is improved.

According to one aspect of the present invention, a golf club head is composed of a metal member made of at least one kind of metal material and a FRP member made of a fiber reinforced resin, the metal member having a first lap joint part, and the FRP member having a second lap joint part lap-jointed with the first lap joint part and a non-lap joint part, wherein the resin content of the second lap joint part is larger than the resin content of the non-lap joint part.

Here, the resin content is a percentage of the weight of the resin component to the overall weight of the object. The resin content can be obtained as follows. To separate the fibers, the resin matrix is removed from the measuring object by chemically dissolving the resin matrix only. Then by subtracting the weight of the fibers from the total weight of the measuring object, the weight of the resin matrix can be obtained. As a specific method, for example, there is "Standard test method for fiber content of resin-matrix composites by matrix digestion" proposed by ASTM D3171–76 (Reapproved 1982).

Further, in preferable, the resin content of the second lap joint part is in a range of from 30 to 60%, and the resin content of the non-lap joint part is not less than 10% and less than 30%.

It is desirable that the metal member includes a face wall portion forming at least a part of a club face for hitting a ball, and the FRP member forms at least a part of a crown portion. Further, in order to improve an adhesive strength, it is desirable that one of the first lap joint part and second lap joint part is provided with at least one securing hole, and the other is provided with at least one protrusion engaging with said at least one securing hole. Further, it is desirable that, for example, the head volume is in a range of from 370 to 550 cc, the height of the center of gravity of the head in a range of from 25 to 35 mm, and the depth of the center of gravity of the head in a range of from 35 to 43 mm.

The depth of the center of gravity of the head corresponds to a horizontal distance GL between the center of gravity G of the head and a leading edge LE in a standard condition in which a head 1 is mounted on a horizontal plane HP at prescribed lie angle and loft angle, as shown in FIG. 15. Further, the height of the center of gravity of the head corresponds to a height GH of a sweet spot SS at which a perpendicular line dropped from the center of gravity G to a club face 2 intersects with the club face 2, from a horizontal plane HP.

BEST MODE FOR CARRYING OUT THE INVENTION

Figure 1:
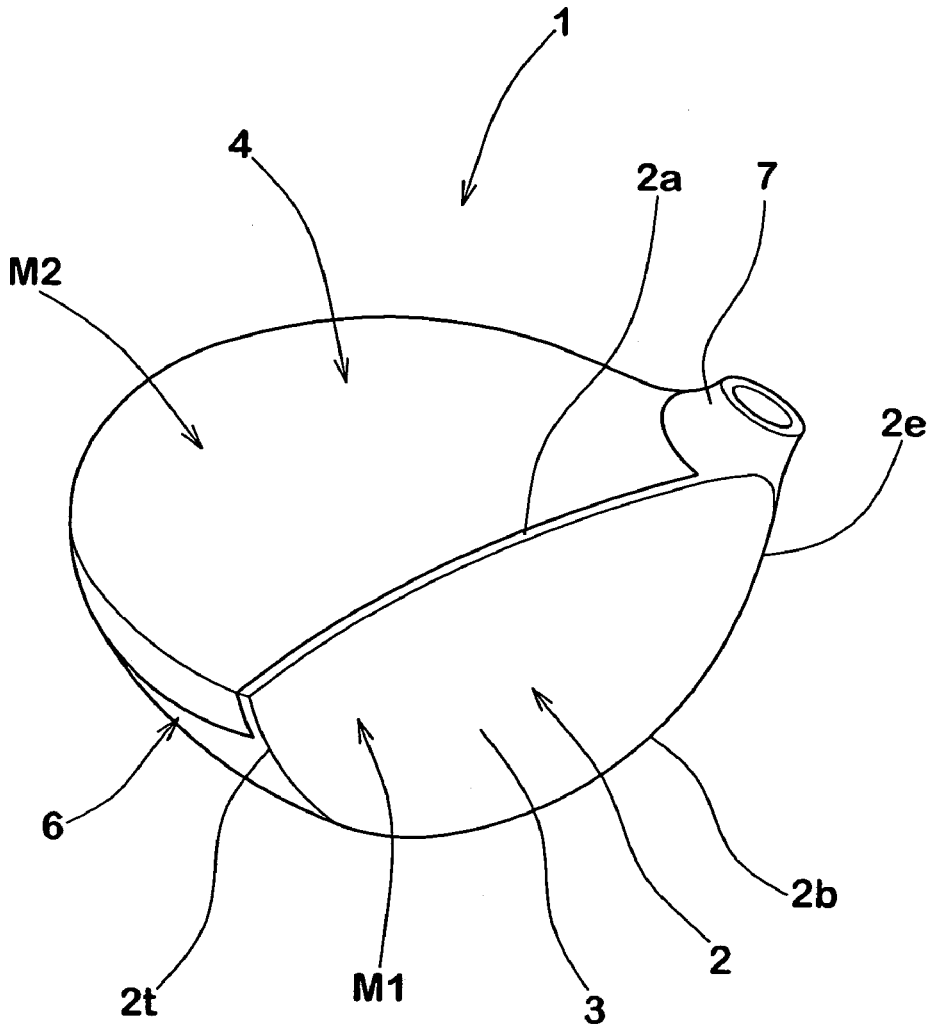
FIG. 1 is a general perspective view showing an embodiment of a head in accordance with the present invention.
Figure 2:
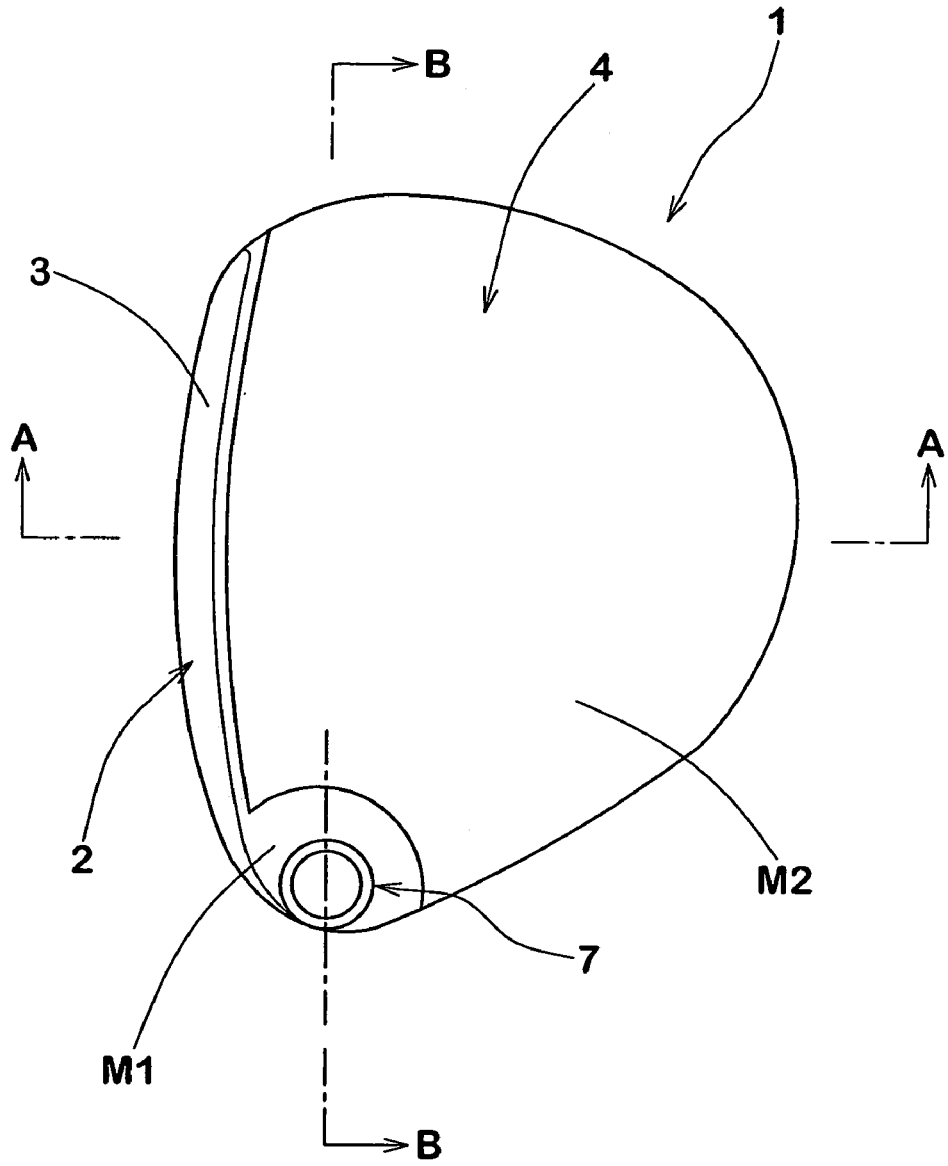
FIG. 2 is a plan view of the head.
Figure 3:
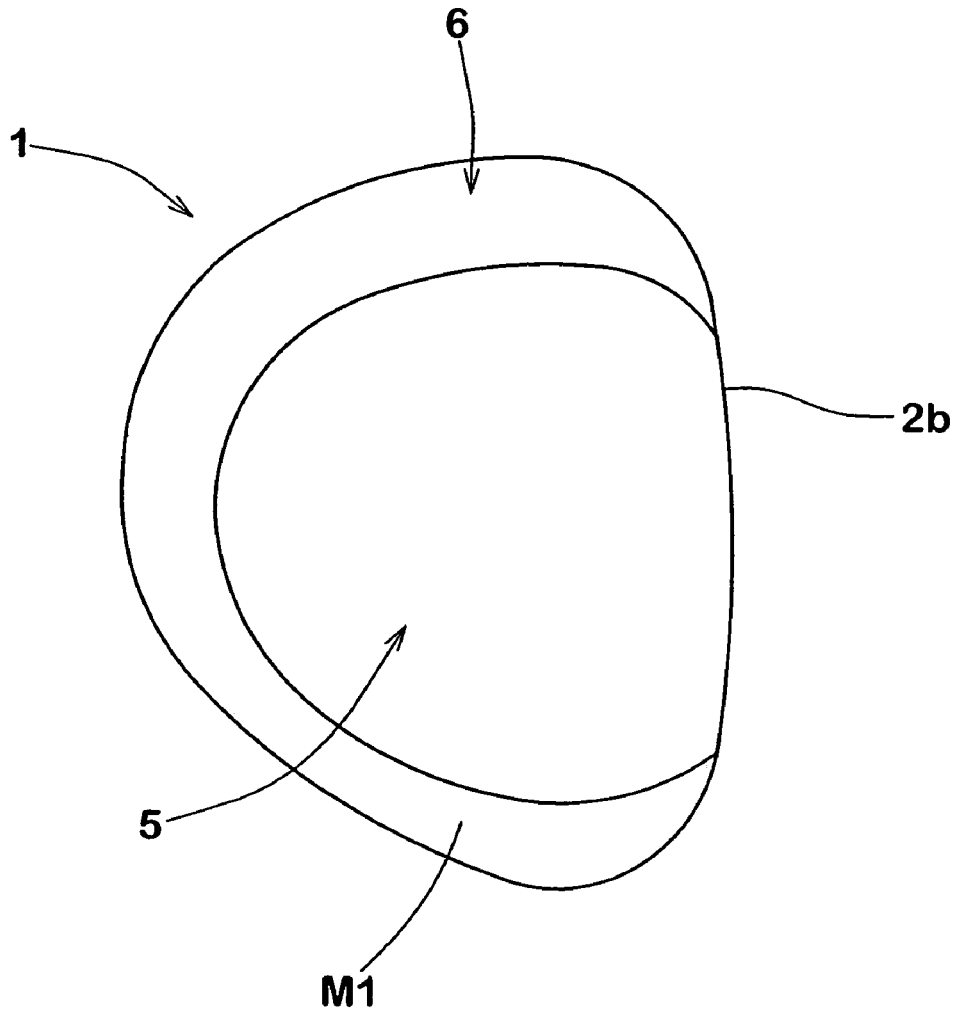
FIG. 3 is a bottom elevational view of the head.

Embodiments of the present invention will now be described in detail in conjunction with the accompanying drawings.

In the drawings, golf club head 1 in accordance with the present embodiment is shown as a wood-type club head such as a driver (#1) or a fairway wood. The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*t* to a heel-side edge 2*e* of the club face 2 through the back face of the club head; and a neck portion 7 to be attached to an end of a club shaft (not shown).

The head 1 has a cavity (i) immediately behind the face portion 3, and in the following embodiments, the cavity (i) is left void although it is also possible to fill it with a light-weight material such as foamed plastic, foamed rubber or the like. Further, the cavity (i) serves for keeping a reverberant sound at a time of hitting a ball long.

The volume of the club head 1 is set in a range of not less than 300 cc, preferably not less than 350 cc, more preferably 350 to 600 cc, still more preferably 370 to 550 cc. The large-sized head further serves for making a hitting sound high and keeping the reverberant sound long.

The head 1 is composed of a metal member M1, and a FRP member M2 attached to the metal member M1. The metal member is made of at least one kind of metal material having a large specific tensile strength. For example, titanium alloys such as alpha+beta titanium alloys and beta titanium alloys are preferred. Specifically, Ti-6Al-4V, Ti-4.5Al-3V-2Fe-2Mo, Ti-2Mo-1.6V-0.5Fe-4.5Al-0.3Si-0.03C, Ti-15V-3Cr-3Al-3Sn, Ti-15Mo-5Zr-3Al, Ti-15Mo-5Zr-4Al-4V, Ti-15V-6Cr-4Al, Ti-20V-4Al-1Sn and the like can be preferably used. However, aside from titanium alloys, various metal materials, e.g. aluminum alloy, pure titanium, stainless steel and the like can be used.

Figure 6:
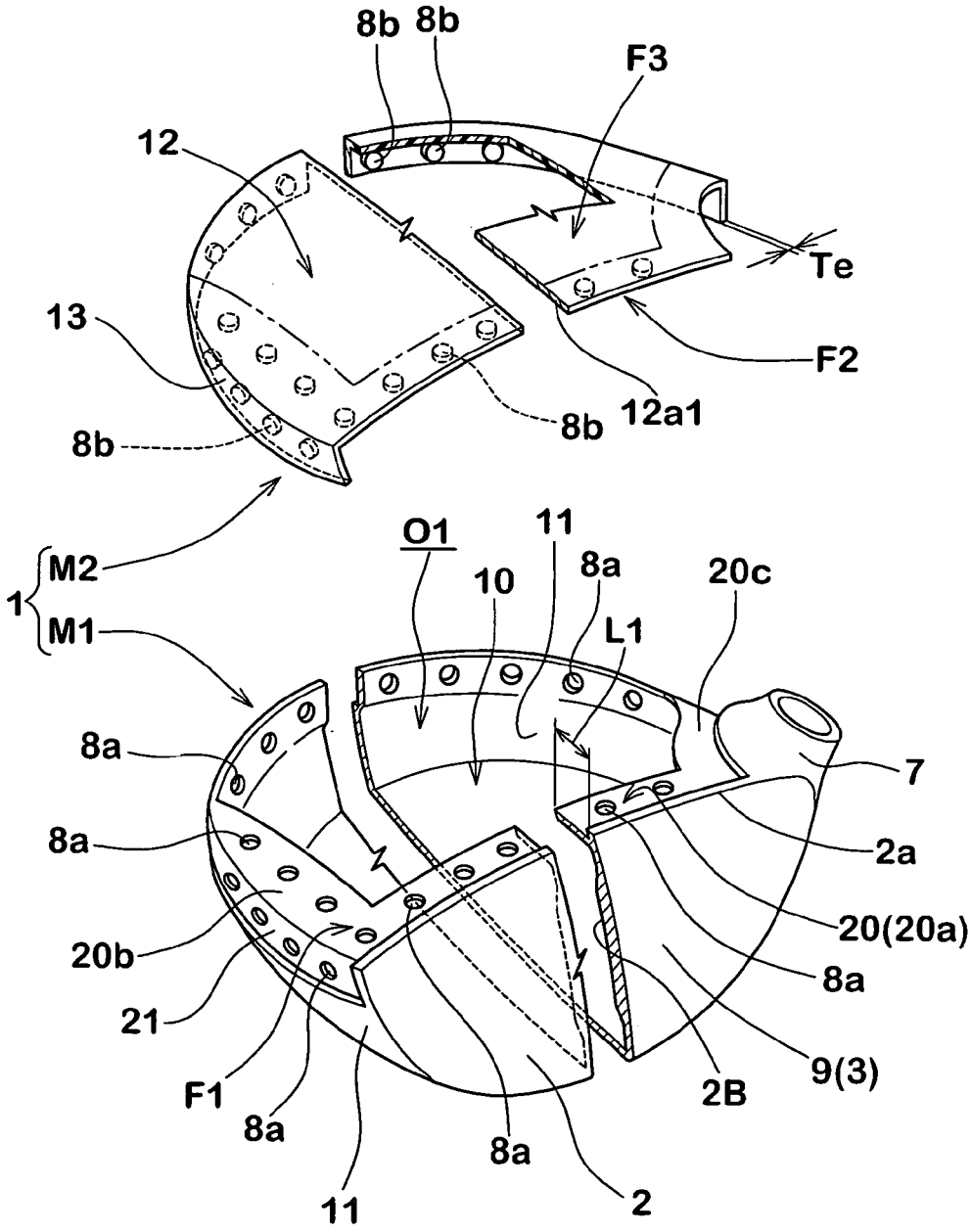
FIG. 6 is an exploded perspective view of the head.
Figure 7:
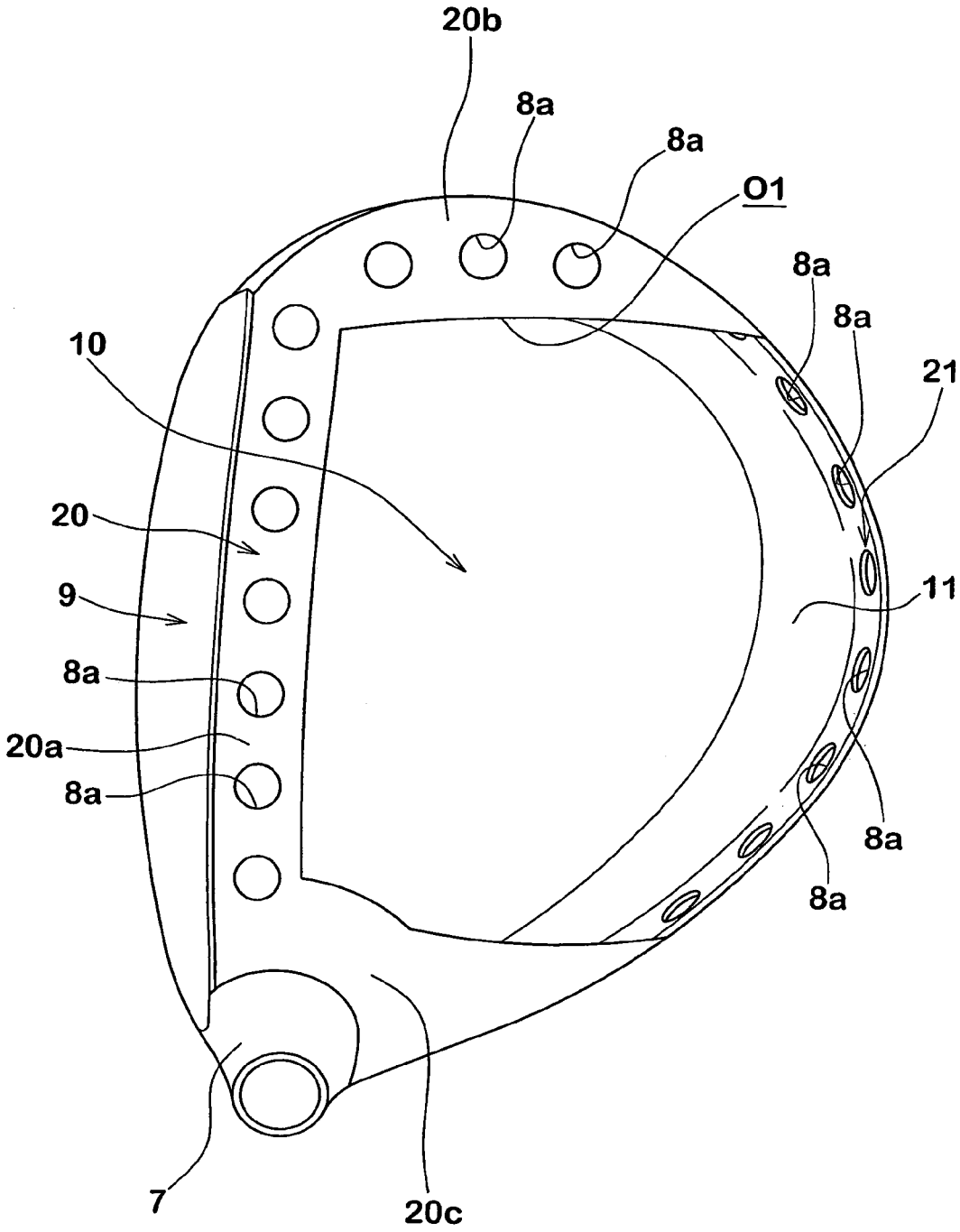
FIG. 7 is a plan view of a metal member.
Figure 8:
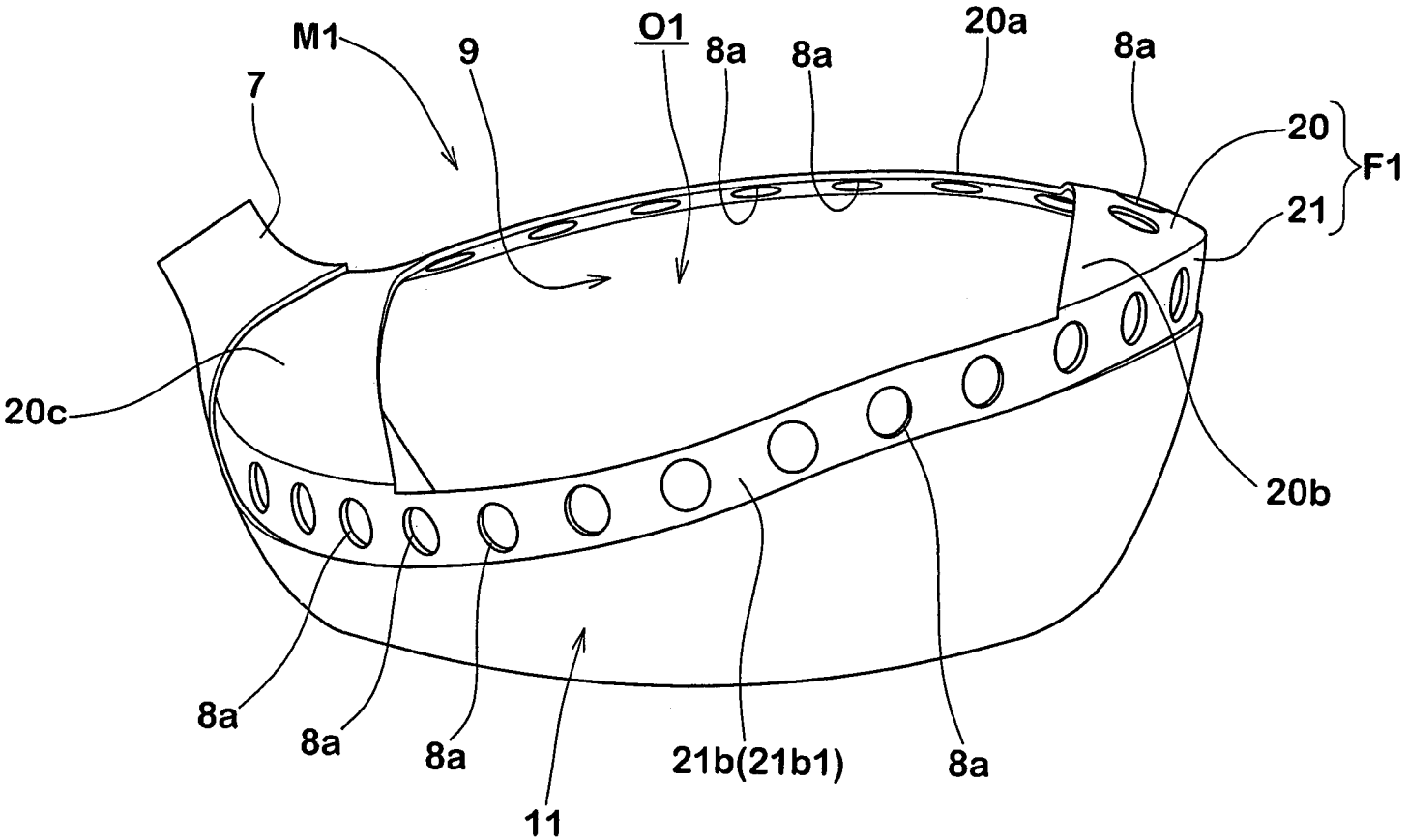
FIG. 8 is a back elevational view of the metal member.

As shown in FIGS. 6 to 8, the metal member M1 integrally includes a face wall portion 9 forming at least a part of the club face 2, a sole wall portion 10 forming at least a part of the sole portion 5, a side wall portion 11 forming at least a part of the side portion 6, the neck portion 7, and an opening O1 on the top thereof.

The face wall portion 9 in accordance with the embodiment has an entire region of the club face 2, however, may be structured such as to form a part of the club face surface 2, for example, only a main portion (for example, 60% or more in an area ratio) of the club face 2.

The face wall portion 9 forms from the club face 2 to a face back surface 2B facing to the cavity (i). Since all of the face wall portion 9 for hitting the ball is made of a metal material, the head 1 in accordance with the present embodiment can achieve an improvement of durability on the basis of a high strength and a high-pitched hitting sound.

Figure 4:
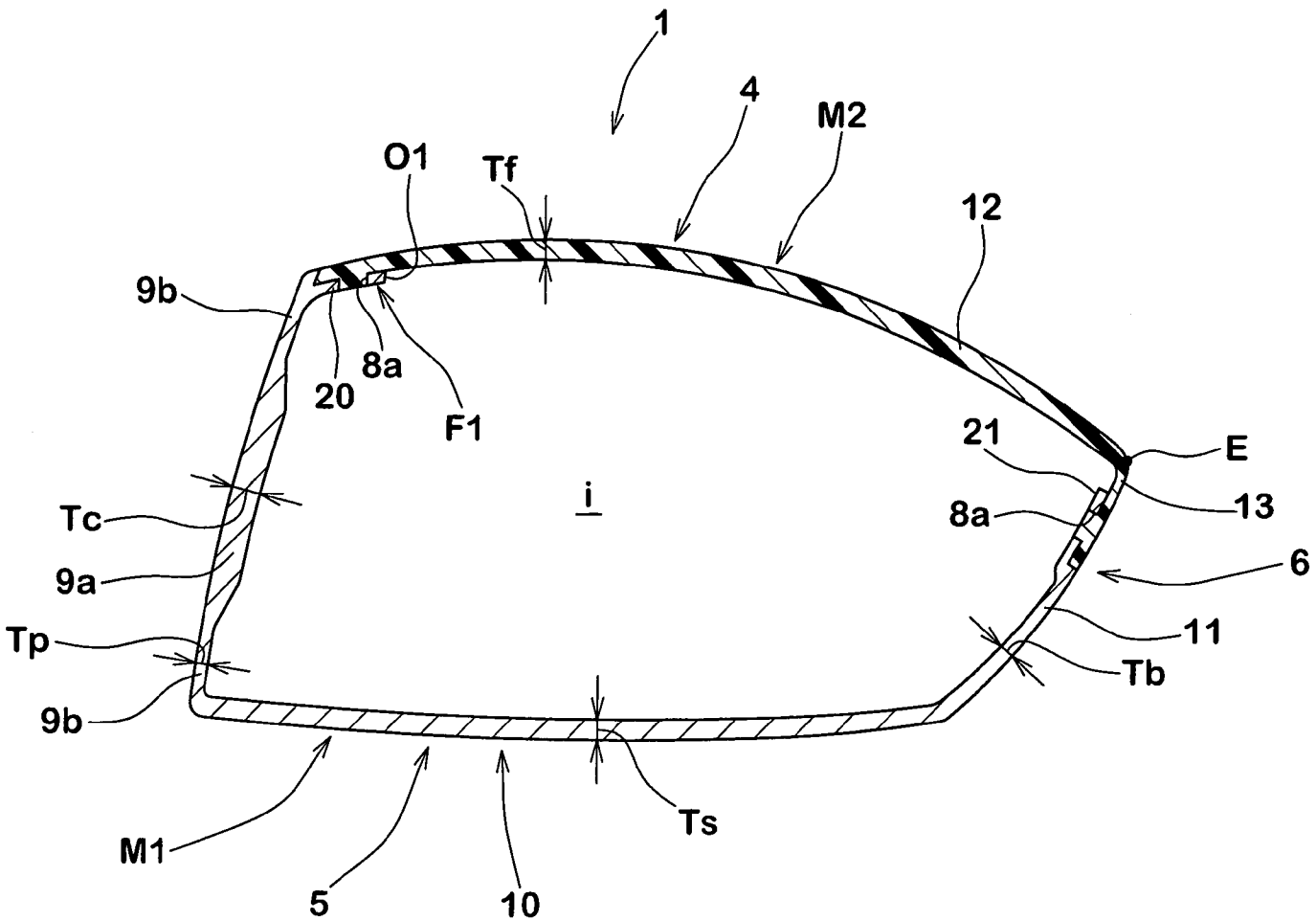
FIG. 4 is an enlarged cross sectional view along a line A—A in FIG. 2.
Figure 5:
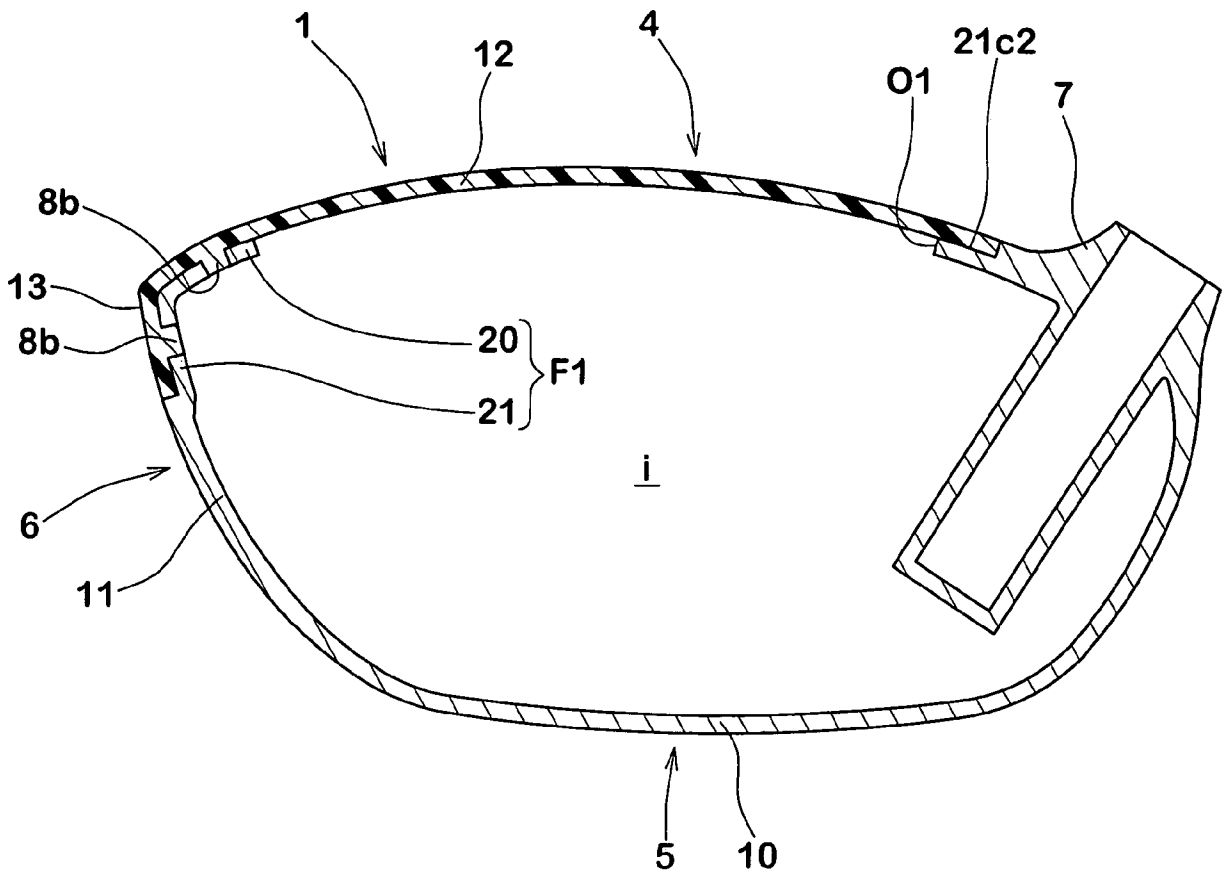
FIG. 5 is an enlarged cross sectional view along a line B—B in FIG. 2.

The thickness of the face wall portion 9 or face portion 3 can be variously determined in view of the used metal material. As shown in FIG. 4, the face portion 3 in accordance with the present embodiment comprises a center region 9*a*, and a peripheral region 9*b* having a smaller thickness than the center region 9*a*. The thickness Tc of the center region 9*a* is preferably set in a range of from 2.5 to 3.0 mm, and more preferably from 2.7 to 2.9 mm. Further, the thickness Tp of the peripheral region 9*b* is preferably set in a range of from 2.0 to 2.5 mm, and more preferably from 2.3 to 2.5 mm. In particularly preferable, the area of the peripheral region 9*b* is in a range of from 20 to 50% of the area of the center region 9*a*.

In the face portion 3 mentioned above, since the thickness of the center region 9*a* which is frequently in contact with the ball is large, durability is high. Further, it is possible to largely elastic deformation the face portion 3 without deteriorating the durability at a time of hitting the ball, owing to the peripheral part 9*b* having a small thickness. Therefore, the head 1 in accordance with the present embodiment efficiently transmits a kinetic energy of the head to the ball and serves for increasing a carry.

The sole wall portion 10 extends backwards from the lower edge of the face wall portion 9 to form at least a major front part of the sole portion 5. The sole wall portion 10 in accordance with the present embodiment comprises all of the sole portion 5. However, for example, the sole wall portion 10 may be comprised such as to have an area of a part of the sole portion 5 (for example, 60% or more of the area of the sole portion 5, more preferably 80% or more). The sole portion 5 tends to be in contact with the ground at a time of swinging. Accordingly, external scratch resistance and durability of the head are further improved by structuring the sole wall portion 10 by a metal material. Further, it is possible to arrange a heavy weight in a lower side of the head, and it is possible to position the center of gravity of the head at a lower side. The thickness Ts of the sole wall portion 10 or sole portion 5 is not particularly limited, however, is preferably set in a range of from 0.9 to 3.0 mm, more preferably from 1.2 to 2.0 mm.

The side wall portion 11 extend upwards from the edge of the sole wall portion 10 along the entire length of the edge continuously from the toe-side edge to the heel-side edge of the face wall 9 through the back face. As shown in FIG. 4, the side wall portion 11 is terminated at a lower height than a boundary E between the crown portion 4 and the side portion 6 in the present embodiment. The thickness Tb of the side wall portion 11 or side portion 6 is not particularly limited, however, it is desirable that the thickness is set in a range of from 0.8 to 6.0 mm, more preferably from 1.0 to 5.0 mm to achieve a balance between strength or durability and a large moment of inertia around the center of gravity.

Further, the metal member M1 is provided around the above-mentioned opening O1 with a first lap joint part F1 which overlaps with a second lap joint part F2 of the FRP member M2. As shown in FIG. 6, the first lap joint part F1 includes a crown joint part 20 and a side joint part 21.

The crown joint part 20 is formed as a part of the crown portion 4 around the opening O1. The crown joint part 20 extends along: a toe-side part of the upper edge of the side wall 11; the entire length of the upper edge 2*a* of the face wall 9; and a heel-side part of the upper edge of the side wall portion 11, through and around the neck portion 7 as best seen in FIG. 6.

In FIGS. 3–7, the side joint part 21 is formed as an upper part of the side wall portion 11, and extends along the upper edge of the side wall portion 11 continuously from the toe to the heel through the back face of the head.

The crown joint part 20 and side joint part 21 are sunken from the adjacent outer surface through a step corresponding to the thickness of the FRP member M2 so that the outer surface of the FRP member M2 becomes flush with the outer surface of the metal part M1 at the boundary therebetween.

The first lap joint part F1 in accordance with the present embodiment includes the crown joint parts 20 and side joint part 21 which bridge two different portions of the crown portion 4 and the side portion 6, in the toe and the heel. The joint parts 20 and 21 mentioned above further improve joint strength with respect to a shear force. Accordingly, the crown portion 4 is protected from a large impact force at a time of hitting the ball. The impact force at a time of hitting the ball is small near the back face. Therefore, the back face side of the first lap joint part F1 in accordance with the present embodiment is constituted only by the side joint part 21 without the crown joint part 20. This serves for a weight reduction and a low gravitational center of the metal member M1.

In order to engage with the undermentioned protrusions 8*b* of the FRP member M2, at least one, preferably a plurality of securing holes 8*a* are formed in the first lap joint part F1 in accordance with the present embodiment. The securing holes 8*a* provided in the crown joint part 20 has a depth in a direction orthogonal to the crown surface. Further, the securing holes 8*a* provided in the side joint part 21 has a depth in a direction orthogonal to the outer surface of the side portion 6. In other words, the securing holes 8*a* has the depth in a direction orthogonal to the joint surface. Further, the securing hole 8*a* in this embodiment has a circular shape, and is formed in a penetrating hole. Further, a plurality of securing holes 8*a* are provided along the first lap joint part F1.

If the width of the first lap joint part F1 (in other words, an overlapping width between the first lap joint part F1 and the second lap joint part F2 of the FRP member) L1 is too small, there is a tendency that a joint area with respect to the FRP member M2 are reduced, and joint strength is reduced. Accordingly, the width L1 is preferably not less than 8.0 mm, and more preferably not less than 12.0 mm. On the contrary, even if the width L1 is too large, an increase in weight of the head tends to be caused. In view of this, the width L1 is preferably not more than 25.0 mm, and more preferably not more than 20.0 nm. Here, the width L1 is a minimum distance across the objective part.

It is preferable that the metal member M1 is constituted, for example, by a casted product which is integrally formed in accordance with a metal casting. Accordingly, it is possible to serve for accurately finishing the loft angle, the lie angle and the like of the head. Further, the securing hole 8*a* may be formed by a metal casting, or may be formed by various machine works (for example, NC work) after the metal casting. Further, there is a case that the metal member M1 is formed by integrating two or more parts individually formed by a forging, a pressing, a metal rolling, a cutting or the like, on the basis of a welding process or the like.

The metal member M1 in accordance with the present embodiment is formed as a casting of a metal material, e.g. Ti-6Al-4V, utilizing a lost-wax precision casting method. Further, the metal member M1 may be constructed such that the sole wall portion 10 may be formed of a different metal material having a larger specific gravity than the other portion. In this case, the metal member M1 is formed by two or more kinds of metal materials having different composition and specific gravity.

The FRP member M2 is attached to the metal member M1 and covers the opening O1. The FRP member M2 comprises the crown wall portion 12 which forms the almost entirety of the surface of the crown portion 4. In the example shown in FIGS. 4–6, the FRP member M2 is also provided with a flange 13 which forms the surface of an upper part of the side portion 6. Thus, the flange 13 extends downward from the edge of the crown wall portion 12 excluding the front edge and neck portion, thus it extends continuously from the toe to the heel. In order to keep out of the neck portion 7, the crown wall 12 is provided with a cutout whose plan view corresponds to about one-third of a circle.

The thickness Tf of the crown wall portion 12 shown in FIG. 4 is not particularly limited, however, if the thickness Tf is too small, there is a tendency that the strength can not be obtained, and if the thickness Tf is too large, a wasteful weight is arranged in the upper portion of the head 1. In view of this, the thickness Tf is preferably set in a range of from 0.2 to 3.0 mm, more preferably from 0.5 to 2.5 mm, and particularly preferably from 0.8 to 2.0 mm. Further, the thickness Te of the flange 13 is not particularly limited, however, if the thickness Te is too small, the strength can not be obtained, and if the thickness Te is too large, the wasteful weight is arranged in the upper portion of the head. In view of this, the thickness Te is preferably set in a range of from 0.2 to 2.0 mm, more preferably from 0.5 to 1.5 mm, and particularly preferably from 0.7 to 1.2 nm.

Since the FRP member M2 is made of the fiber reinforced resin having the smaller specific gravity than the metal material, the FRP member M2 is light. Accordingly, it is possible to easily achieve a large size of the head volume. Further, it is possible to reduce the weight of the head upper portion and it is possible to design the head having the low center of gravity, by employing the FRP member M2 for the crown portion 4.

Further, the FRP member F2 has a second lap joint part F2 which is lap-jointed with the first lap joint part F1 and a non-lap joint part F3 which is not lap-jointed with the first lap joint part F1. The non-lap joint part F3 faces to the cavity (i) in this embodiment. The second lap joint part F2 is structured such as to include a crown wall portion 12 and the flange 13. The boundary line between the second lap joint part F2 and the non-lap joint part F3 is shown by a alternate long and two short dashes line in FIG. 6.

A resin content of the second lap joint part F2 is set to be larger than a resin content of the non-lap joint part F3. As a result of various experiments by the inventors, it has been known that a bonding strength between the fiber reinforced resin and the metal material is improved in accordance with an increase of the resin content of the fiber reinforced resin. Because it is presumed that a crack resistance in the adhesive interface of the fiber reinforced resin is improved on the basis of the reduction in the fiber amount. In the head 1 in accordance with the present invention, it is possible to inhibit a micro crack in the adhesive interface which has conventionally tended to cause a damage from being generated for a long time. Accordingly, it is possible to secure a sufficient bonding strength with respect to the shear force which is repeatedly applied at a time of hitting the ball.

On the other hand, if the resin content of all the fiber reinforced resin is increased, an amount of the resin having a higher specific gravity than the fiber is increased. Accordingly, the weight increase of the FRP member is caused, and the weight saving of the head is prevented. In the present invention, the weight increase of the FRP member M2 is prevented while making the adhesive strength high, by making the resin content of the second lap joint part F2 larger than the resin content of the non-lap joint part F3, in the FRP member M2, as mentioned above.

The resin content of the second lap joint part F2 is preferably set in a range of from 30 to 60%, more preferably from 30 to 50%, and further preferably from 30 to 40%. In the case that the resin content of the second lap joint part F2 is less than 30%, there is a tendency that an effect of improving the adhesive strength with the metal material can not be sufficiently obtained, and on the other hand, if it is more than 60%, the specific gravity of the second lap joint part F2 is larger, and the weight of the FRP member M2 is increased by extension. Further, the resin content of the non-lap joint part F3 of the FRP member M2 is preferably set in a range of not less than 10% and less than 30%, and more preferably between from 10 to 20%. Because the reduction in strength tends to be generated if it is less than 10%, and the weight increase tends to be generated if it is equal to or more than 30%.

Further, the second lap joint part F2 in accordance with the present embodiment is provided with a plurality of protrusions 8*b* which are engaging to the securing holes 8*a* provided in the first lap joint part F1. The protrusion 8*b* is formed, for example, as a cylindrical projection which protrudes toward the metal member M1. Each of the protrusion 8*b* exists at a position corresponding to the each securing hole 8*a*. Further, the protruding height of the protrusion 8*b* is substantially equal to or smaller than the depth of the securing hole 8*a*. Further, in the case of attaching the FRP member M2 to the metal member M1 while melting, if the resin content of the second lap joint part F2 is high, the resin tends to flow into the securing hole 8*a* of the first lap joint part F1, and the adhesive strength can be further increased.

As the reinforced fiber employed for the fiber reinforced resin, a carbon fiber is preferable, for example, an elastic modulus in tension is not less than 200 GPa, more preferably not less than 240 GPa, further preferably not less than 290 GPa, and particularly preferably between 290 and 500 GPa. In this case, the elastic modulus in tension of the carbon fiber is a value which is measured in accordance with JIS R7601: 1986 "carbon fiber testing method".

In specific, the fiber shown in Table 1 is preferable.

TABLE 1

| Manufacturer | Kind of carbon fiber | Elastic modulus in tension ton/mm$^2$ | Elastic modulus in tension GPa |
|---|---|---|---|
| Mitsubishi Rayon Co., Ltd. | TR50S | 24.5 | 240.3 |
| | MR40 | 30.0 | 294.2 |
| | HR40 | 40.0 | 392.3 |
| Toray Industries, Inc. | T700S | 23.5 | 230.5 |
| | T300 | 23.5 | 230.5 |
| | T800H | 30.0 | 294.2 |
| | M30SC | 30.0 | 294.2 |
| | M40J | 38.5 | 377.6 |
| | M46J | 46.0 | 451.1 |
| Toho Tenax Co., Ltd. | UT500 | 24.5 | 240.3 |
| | HTA | 24.0 | 235.4 |
| | IM400 | 30.0 | 294.2 |
| Nippon Graphite Fiber Corporation | YS-80 | 80.0 | 784.5 |

A sheet-like prepreg is structured by impregnating the fiber, for example, with an epoxy thermosetting resin. The fiber is oriented, for example, in random directions, in a woven fabric shape or in one direction. The FRP member M2 can be formed by cutting the prepreg in a predetermined shape and laminating by a necessary number of sheets so as to harden. In the case of laminating the prepreg, it is preferable in view of improvement of the strength to intersect the fibers with each other in each of the layers.

The FRP member M2 can be formed in accordance with various methods, and the methods are not limited to the aspect mentioned above. In the case that the FRP member M2 is separately formed from the metal member M1, both the elements are firmly attached to each other, for example, by using an adhesive agent. Further, there is a case that the FRP member M2 is formed in accordance with an integrally forming method.

Figure 14A:
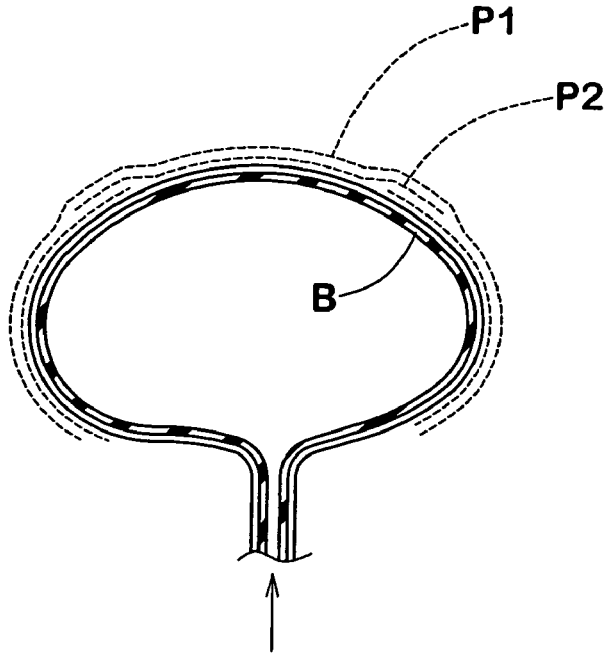
FIG. 14(A) and FIG. 14(B) are perspective views showing an example of a manufacturing method of the FRP member.
Figure 14B:
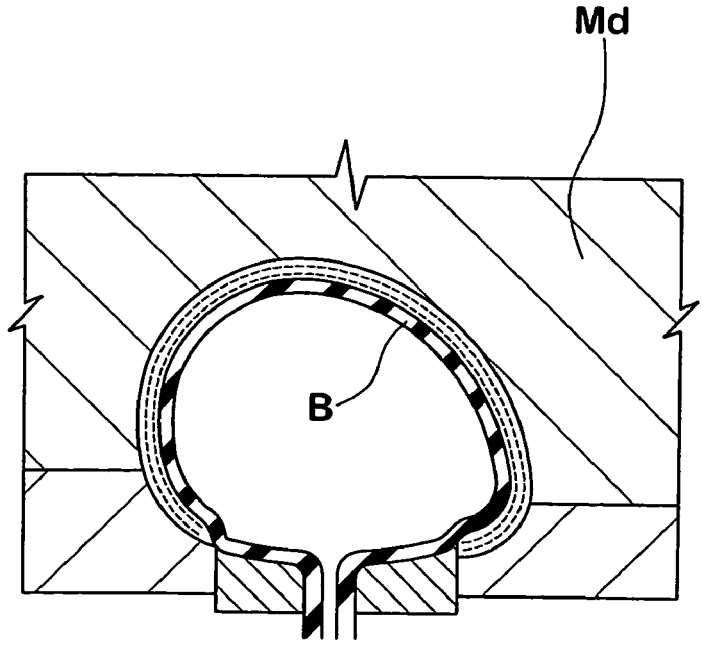

As shown in FIGS. 14(A) and 14(B), the integrally forming method employs an expandable bladder B in which a fluid is sealed in an inner portion, and a mold Md. A laminated body of prepreg P1, P2, . . . corresponding to the fiber reinforced resin sheet in an uncured state or a half-cured state is pressed in one surface by the mold Md and in another surface by the expanded bladder B, respectively. Accordingly, the laminated body of the prepreg is formed in a predetermined shape of the mold Md. The prepreg having a higher resin content in comparison with the non-lap joint part F3 is used in the portion forming the second lap joint part F2. Therefore, the resin content of the second lap joint part F2 can be made high.

Further, it is possible to simultaneously form the second head member M2 and firmly attached the FRP member M2 to the first lap joint part F1, by heating the metal member M1 in which the opening O1 is covered with the prepreg, within the mold Md. In this case, it is possible to equip the bladder B in the cavity (i) of the metal member M1, expand the bladder from the cavity (i) of the head in the mold Md, and form the prepreg to the FRP member M2 along the mold Md.

Further, the protrusion 8*b* provided in the second lap joint part F2 can be firmly attached at a later stage, for example, in accordance with a thermal welding process or the like, and the resin may be flown into the securing holes 8*a* so as to be solidified at the same time of molding, in accordance with the integral molding method mentioned above. In this case, an adhesive agent may be interposed between the first lap joint part F1 and the second lap joint part F2.

In the head 1 manufactured in the manner mentioned above, since the resin content of the second lap joint part F2 is set large, the adhesive strength with the first lap joint part F1 corresponding to the metal material is high. Further, in accordance with the present embodiment, in addition to the improved adhesive strength, a mechanical connection (a so-called anchor effect) on the basis of the fitting between the protrusion 8*b* and the securing hole 8*a* can be obtained. Accordingly, it is possible to further improve strength in the joint part. Further, at a time of firmly attaching mentioned above, the adhesive agent is not necessarily used, and it is possible to utilize the attaching force of the matrix resin itself of the fiber reinforced resin, for example, as in the integral molding method.

Figure 9:
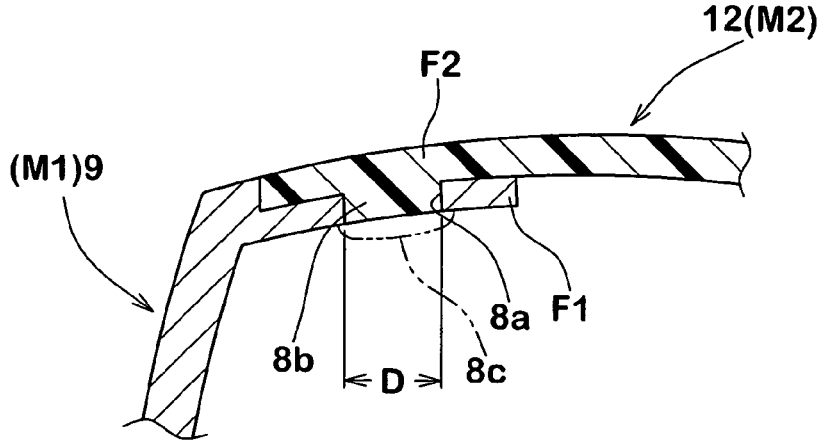
FIG. 9 is a cross sectional view showing a joint part between the metal member and a FRP member in an enlarged manner.

With regard to the securing hole 8*a*, if the maximum diameter D (for example, shown in FIG. 9) of the securing hole 8*a* is too small, the protrusion 8*b* fitted thereto has a small diameter, and there is a tendency that the shear strength is reduced. On the contrary, if the maximum diameter D of the securing hole 8*a* is too large, the strength of the joint part tends to be reduced. Not being limited particularly, the maximum diameter D of the securing hole 8*a* is preferably set in a range of from 2.0 to 8.0 mm, more preferably from 3.0 to 5.0 mm. In particularly preferable, the volume of one securing hole 8*a* is preferably set in a range of from 1.5 to 102.0 mm$^3$, more preferably from 5.6 to 30.0 mm$^3$. Further, the securing hole 8*a* and the protrusion 8*b* can be executed in accordance with various shapes such as an oval shape, an elliptic shape, a slit shape, a polygonal shape and the like in addition to the circular shape. Further, as shown by a virtual line, a come-off preventing expanded portion 8*c* may be provided in a leading end of the protrusion 8*b* at a later stage.

Figure 10:
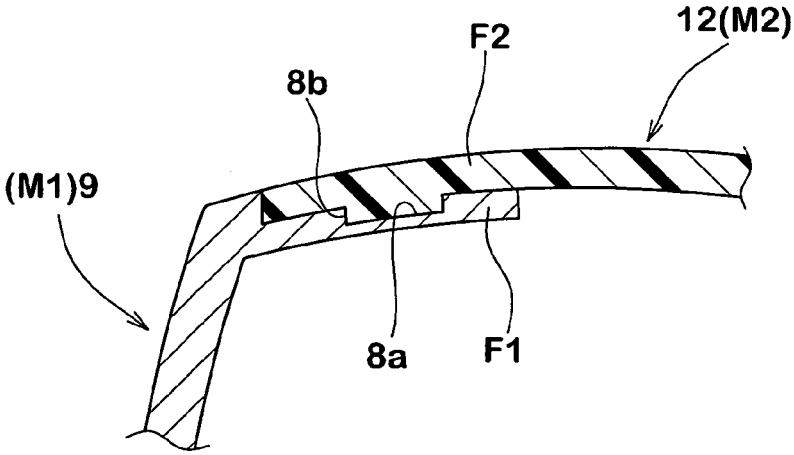
FIG. 10 is a cross sectional view showing a joint part between the metal member and the FRP member in accordance with another embodiment in an enlarged manner.
Figure 11:
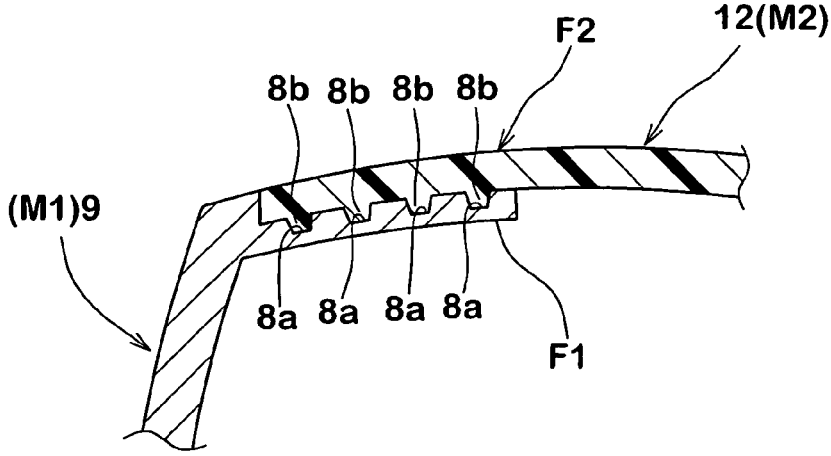
FIG. 11 is a cross sectional view showing a joint part between the metal member and the FRP member in accordance with still another embodiment in an enlarged manner.
Figure 12:
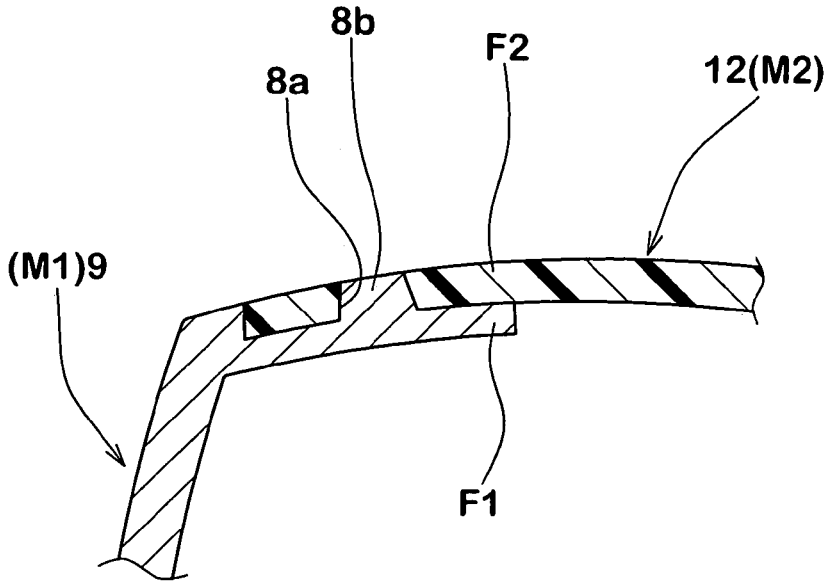
FIG. 12 is a cross sectional view showing a joint part between the metal member and the FRP member in accordance with still another embodiment in an enlarged manner.

The securing hole 8*a* in accordance with the present embodiment is constituted by a through hole, however, may be constituted by a closed-end hole, as shown in FIG. 10. In the case of the closed-end hole, the depth of the hole is preferably set in a range of from 0.5 to 2.0 mm, more preferably from 0.8 to 1.5 nm. In the case that the depth is less than 0.5 nm, a sufficient anchor effect can not be obtained, and on the contrary, if it is more than 2.0 mm, the thickness of the joint part F1 or F2 is increased. In the case that the securing hole 8*a* is constituted by the closed-end hole, the securing hole may be formed in a groove shape extending continuously or intermittently along the opening O1, as shown in FIG. 11. A plurality of these groove-shaped securing holes 8*a* may be formed. Further, as shown in FIG. 12, the structure may be made such that the securing hole 8*a* is provided in the second lap joint part F2, and the protrusion 8*b* is provided in the first lap joint part F1. Further, the embodiments mentioned above may be appropriately combined or the protrusion 8*b* and the securing hole 8*a* may be provided in both the first and second lap joint parts F1 and F2.

In particularly preferable, the total area S1 of the securing hole corresponding to a summation of the areas of the individual securing holes 8*a* (a surface area of the depressed portion) is preferably set in a range of from 20 to 70% of the joint total area S of the first or second lap joint part F1 or F2 (the total adhesive area without the securing hole), more preferably from 30 to 60%. Accordingly, it is possible to maintain adhesive strength by the adhesive agent and mechanical connecting strength by the fitting between the protrusion 8*b* and the securing hole 8*a* with a good balance, and it is possible to further improve the joint strength.

Figure 13:
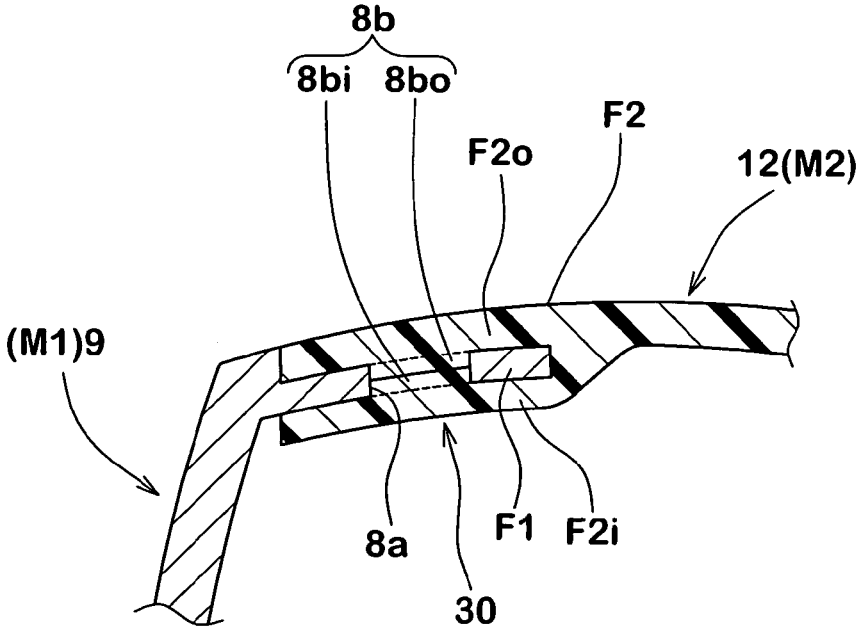
FIG. 13 is a cross sectional view showing a joint part between the metal member and the FRP member in accordance with yet another embodiment in an enlarged manner.

FIG. 13 shows the other embodiment. In this embodiment, the second lap joint part F2 includes a bifurcated portion 30 having an inner piece F2*i* which is lapped over the first lap joint part F1 in the inner side of the head, and an outer piece F2*o* which is lapped over the first lap joint part F1 in an outer side of the head. Since the inner piece F2*i* and the outer piece F2*o* have the resin content of 30 to 60%, and are firmly adhered to both sides of the first lap joint part F1, a higher adhesive strength can be obtained.

Further, this embodiment is provided with a protrusion 8*b* which connects between the inner piece F2*i* and the outer piece F2*o*. The protrusion 8*b* comprises, for example, an inner protrusion 8*bi* protruding toward an upper side from the inner piece F2*i* and an outer protrusion 8*bo* protruding toward a lower side from the outer piece F2*o*. Further, it is possible to form by arranging the prepreg in inner and outer sides of the first lap joint part F1 and integrally forming as mentioned above. The protrusion 8*b* mentioned above further improves the bonding strength and improve durability of the head by connecting the inner piece F2*i* to the outer piece F2*o*.

The head 1 in accordance with the present embodiment can make the ball hitting sound high, maintain the reverberant sound after hitting a ball for a long time, and provide a comfortable ball hitting feeling to a player. Further, the head 1 can save the weight of the head on the basis of the small specific gravity of the FRP member M2. The reduced weight can be allocated, for example, in the sole portion or the like, and can improve degree of freedom in the weight allocation design or the like. Accordingly, it is possible to achieve a significant low senter of gravity while maintaining the head volume in a large size. For example, it is possible to provide a head which has a head volume equal to or more than 300 cc and the depth GL of the center of gravity G from 35 to 43 mm, more preferably from 37 to 43 nm, further preferably from 38 to 43 mm. Further, the height GH of the center of gravity of the head 1 can be set preferably from 25 to 35 mm, more preferably from 25 to 32 mm, further preferably from 25 to 30 mm.

Figure 15:
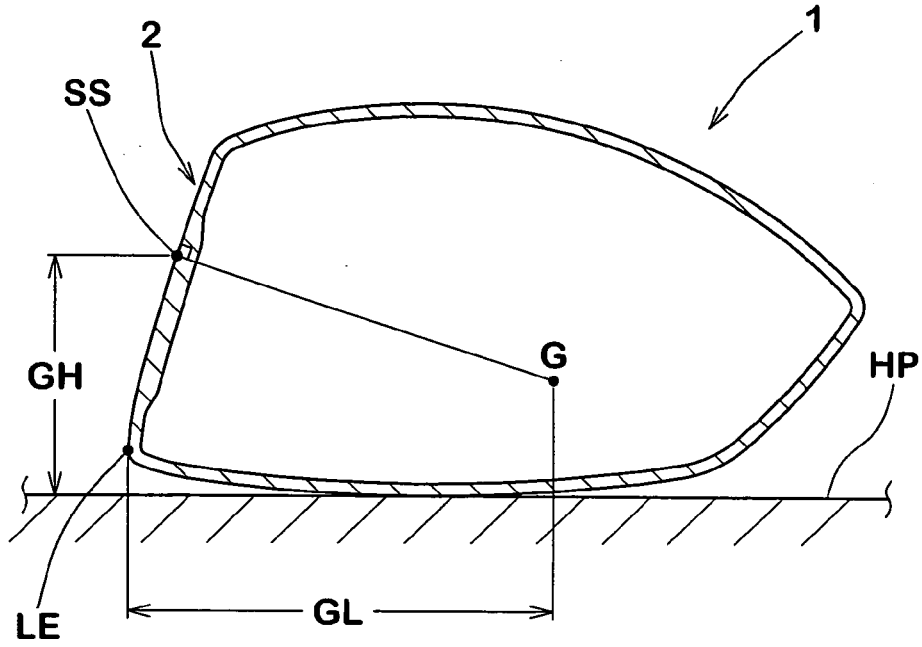
FIG. 15 is a cross sectional view of a head explaining a gravitational center depth and a sweet spot height.
Figure 16:
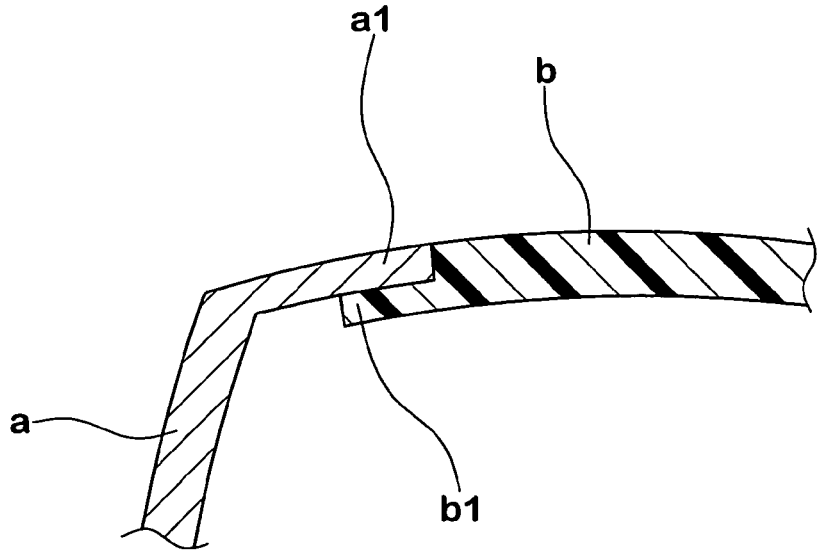
FIG. 16 is a cross sectional view showing a joint part between a metal member and a fiber reinforced resin member in an enlarged manner, in a conventional golf club head.

A sweet area of the head is significantly increased by setting the depth GL of the center of gravity equal to or more than 35 mm. Accordingly, even in the case of hitting the ball while deviating from the sweet spot SS (shown in FIG. 15), it is possible to reduce a displacement of the head to a minimum level, and it is possible to stabilize a directionality of the ball. Further, since the height GH is low, it is possible to increase the face area in the upper side of the sweet spot SS and it is possible to easily hit the ball in this area. In this case, a backspin amount of the ball can be reduced on the basis of a vertical gear effect, and a ball hitting angle can be improved. This can form an ideal ballistic trajectory for good flying.

It goes without saying that the present invention can be applied to an iron type or putter type head in addition to the wood type head. Further, in the embodiment mentioned above, there is shown the structure in which the first lap joint part F1 and the second lap joint part F2 are fitted by the securing hole 8*a* and the protrusion 8*b*, however, it goes without saying that even in the case that the securing hole and the protrusion are omitted, a practically sufficient adhesive strength can be obtained.

EXAMPLES

A golf club head with a head volume of 400 cc having a basic aspect shown in FIG. 1 is manufactured by way of trial on the basis of the specification in Table 2. An evaluation is executed with respect to durability, a carry of the ball and a hitting sound. With respect to comparative embodiments 1 and 2, and embodiments 1 to 4, the metal member is formed in a basic shape shown in FIG. 6, and Ti-6Al-4V is integrally formed in accordance with a lost wax precision casting method. Further, an embodiment 5 is structured such that the fiber reinforced resin is used in the sole portion and the other portion is made of the metal material. Further, with respect to the structure having the securing hole, the securing hole is formed in a circular shape having a diameter of 3.0 mm, and as a through hole and a closed-end hole, respectively. Further, a ratio (S1/S) between the securing hole total area S1 and the joint total area S between the first and second lap joint parts F1 and F2 is changed by changing the number of the securing hole. In this case, the head in accordance with the comparative embodiment is formed by removing the securing hole and the protrusion from the first and second lap joint parts. Further, as a unified specification of the metal member, thickness in each of the portions is set as follows.

Thickness Tc of center region of face portion: 2.8 mm

Thickness Tp of peripheral region of face portion: 2.0 mm

Area ratio (peripheral region/center region): 20%

Thickness Ts of sole wall portion: 1.3 mm

Thickness Tb of side wall portion: 1.0 mm

Further, the FRP member is manufactured by integrally forming with the metal member within the metal mold. The carbon fiber employs "T700S", "T800H" and "M40J" manufactured by Toray Industries, Inc. Thickness in each of the portions is as follows.

Thickness Tf of crown wall portion of crown wall portion: 0.8 μmm

Thickness Te of the flange: 0.8 mm

The first and FRP members are firmly attached by the epoxy adhesive agent. Further, the testing method is as follows.

<Durability>

A 45 inch wood type golf club is manufactured by way of trial by attaching the same shaft made of FRP to each of the trial heads. The club is mounted to a swing robot and hits a golf ball ("MAXFRI HI-BRID" manufactured by Sumitomo Rubber Industries Ltd. per 3000 balls at a head speed of 54 m/s. A degree of damage in the face surface is observed visually.

<Carry of Ball>

Each of the trial clubs mentioned above is mounted to the swing robot, the golf ball is hit by each of the clubs per five balls at the head speed of 45 m/s, and an average carry (carry+run) of the hit ball is measured. Results are expressed by index obtained by setting the comparative embodiment 1 to 100. The larger the numerical value the better.

<Feeling>

The ball is hit by fifty test golfers, a questionnaire survey is executed with regard to whether or not the hitting feeling is good. The head for which twenty five or more golfers answer that the hitting feeling is good is marked as "Good" and the other heads are marked as "Not good". Results of test are shown in Table 2.

TABLE 2

| | Comparative Example 1 | Comparative Example 2 | Example 1 | Example 2 | Example 3 | Example 4 | Example 5 |
|---|---|---|---|---|---|---|---|
| Metal member | Face wall portion + sole wall portion + side wall portion + neck portion | | | | | | Face wall portion + crown wall portion + side wall portion + neck portion |
| FRP member | | | Crown wall portion | | | | Sole wall portion |
| Resin content of second lap joint part [%] | 25 | 35 | 35 | 45 | 57 | 35 | 35 |
| Resin content of non-lap joint part [%] | 25 | 35 | 25 | 25 | 25 | 25 | 25 |
| Shape of securing hole (depth) | Without securing hole | Without securing hole | Without securing hole | Without securing hole | Without securing hole | Through hole (depth 0.8 mm) | Through hole (depth 0.8 mm) |
| Ratio (S1/S) [%] | 0 | 0 | 0 | 0 | 0 | 10 | 10 |
| Test results | | | | | | | |
| Durability test | Breakby200 balls | OK | OK | OK | OK | OK | OK |
| Carry (yard) | 210 | 198 | 215 | 212 | 210 | 209 | 180 |
| Feeling | Good | Not good | Not good | Good | Good | Good | Good |
| Gravitational center depth [mm] | 36 | 33 | 38 | 36 | 36 | 36 | 36 |
| Gravitational center height [mm] | 29 | 35 | 29 | 30 | 31 | 30 | 42 |
| Head mass [g] | 185 | 195 | 188 | 191 | 192 | 186 | 195 |

As a result of the test, it is possible to confirm that the heads in accordance with the examples achieve an excellent durability and has a good carry. Good results can be obtained also in the ball hitting feeling.

The invention claimed is:

1. A golf club head composed of a metal member made of at least one kind of metal material and a FRP member made of a fiber reinforced resin, the metal member having a first lap joint part, and the FRP member having a second lap joint part lap-jointed with the first lap joint part and a non-lap joint part, wherein the resin content of the second lap joint part is larger than the resin content of the non-lap joint part.

2. A golf club head according to claim 1, wherein the resin content of the second lap joint part is in a range of from 30 to 60%, and the resin content of the non-lap joint part is not less than 10% and less than 30%.

3. A golf club head according to claim 1 or 2, wherein the metal member includes a face wall portion forming at least a part of the club face for hitting a ball, and the FRP member forms at least a part of a crown portion.

4. A golf club head according to claim 1, wherein one of the first lap joint part and second lap joint part is provided with at least one securing hole, and the other is provided with at least one protrusion engaging with said at least one securing hole.

5. A golf club head according to claim 1, wherein the metal member includes a face wall portion forming at least a part of the club face for hitting a ball, a sole wall portion forming at least a part of a sole portion of the head, a side wall portion forming at least a part of a side portion of the head and an opening on the top thereof, and the FRP member covers the opening and forms at least a part of a crown portion of the head.

6. A golf club head according to claim 5, wherein the first lap joint part is formed continuously along the entire circumference of the opening, and the second lap joint part is formed continuously along the entire circumference of the FRP member.

7. A golf club head according to claim 5 or 6, wherein the first lap joint part includes a side joint part formed as an upper part of the side wall portion, and a crown joint part formed as a part of the crown portion and connected to said side joint part.

8. A golf club head according to claim 7, wherein the first lap joint part has both the side joint part and crown joint part, on a toe side and/or a heel side thereof.

9. A golf club head according to claim 7, wherein the first lap joint part is formed only by the side joint part on a back face side thereof, and is not provided with the crown joint part.

10. A golf club head according to claim 1, wherein the head volume is in a range of from 370 to 550 cc, the height of the center of gravity of the head in a range of from 25 to 35 mm, and the depth of the center of gravity of the head in a range of from 35 to 43 mm.

* * * * *